United States Patent [19]

Cederholm et al.

[11] 4,067,138

[45] Jan. 10, 1978

[54] PNEUMATICALLY ACTUATED WALKING DOLL

[75] Inventors: Carl Cederholm, Providence, R.I.; Robert H. Hudson, Seekonk, Mass.

[73] Assignee: Hasbro Development Corporation, Pawtucket, R.I.

[21] Appl. No.: 727,388

[22] Filed: Sept. 27, 1976

Related U.S. Application Data

[63] Continuation of Ser. No. 613,192, Sept. 15, 1975, abandoned.

[51] Int. Cl.[2] ..... A63H 29/16

[52] U.S. Cl. ..... 46/44; 46/150

[58] Field of Search ..... 46/44, 149, 150

[56] References Cited

U.S. PATENT DOCUMENTS

| | | | |
|---|---|---|---|
| 2,883,795 | 4/1959 | Baggott | 46/149 X |
| 3,346,989 | 10/1967 | Ryan et al. | 46/44 |
| 3,600,845 | 8/1971 | Mendigal | 46/44 |
| 3,740,893 | 6/1973 | Shinoda | 46/150 X |

*Primary Examiner*—F. Barry Shay

*Attorney, Agent, or Firm*—Salter & Michaelson

[57] ABSTRACT

A walking doll having a hollow body on which arms and legs are mounted, the legs being mounted for pivotal movement to effect a walking action, a pneumatically operated assembly being located within said body and interconnected to the legs for producing the pivotal movement thereof, the pneumatically operated assembly including independently operated bellows units that communicate with manually operated members that define the hands of the doll and that are responsive to alternate pressure exerted thereon for producing the walking action of the legs.

14 Claims, 11 Drawing Figures

PNEUMATICALLY ACTUATED WALKING DOLL

This is a continuation of application Ser. No. 613,192, filed Sept. 15, 1975, now abandoned.

BACKGROUND OF THE INVENTION

The present invention relates to a toy doll and more particularly relates to a walking doll, wherein the walking action thereof is controlled by a mechanism located interiorly of the body of the doll.

Walking dolls have been constructed heretofore, and for the most part have usually included some kind of a mechanically operated device that is interconnected to the legs of the doll, whereupon operation of the devive by the user produces the walking movement of the legs. Some mechanical devices are known heretofore have been spring wound and in other instances have included a small electric motor that was battery operated for producing the required operation. Although such prior known operating mechanisms for walking dolls produced to some degree, the desired effect, they were complicated and costly, and furthermore since they were not very sturdy in construction, they could not withstand the rigors of normal play by a child.

Some attempts have been made heretofore to construct a walking doll having the operating mechanism thereof controllable by pneumatically operated means. However, such prior known pneumatically operated devices for use in walking dolls were not constructed in a manner to enable a child to easily manipulate and maneuver the doll, and moreover such mechanisms were also not very resistent to the normal play action experienced with use by a child, and, as a result, have not been accepted by the trade.

SUMMARY OF THE INVENTION

The present invention relates to a walking doll that incorporates a pneumatically operated mechanism therein for producing the walking action of the doll.

The pneumatically operated mechanism as embodied in the walking doll of the present invention includes independently operated pneumatic systems, each of which is operatively interconnected to a hollow member of the doll that defines a hand thereof. As each of the hands of the doll are squeezed in alternate relation with respect to the other, the pneumatic systems are operated in response thereto to produce a pivotal movement of a rod that is operatively connected to the pneumatic systems. As the rod pivots, a motion translating device that is operatively connected to the rod translates the pivotal movement thereof to a simulated walking movement of the legs of the doll.

Accordingly, it is an object of the present invention to provide a walking doll that incorporates therein independently operated pneumatic systems that include hollow hands joined to the arms of the doll, wherein a walking motion of the legs of the doll is produced when the hollow hands are manually squeezed to operate the pneumatic systems.

Other objects, features and advantages of the invention shall become apparent as the description thereof proceeds when considered in connection with the accompanying illustrative drawings.

DESCRIPTION OF THE INVENTION

In the drawings which illustrate the best mode presently contemplated for carrying out the present invention:

DESCRIPTION OF THE INVENTION

Figures 1, 2, 3, 4, 5, 6, 7, 8, 9, 10, 11:
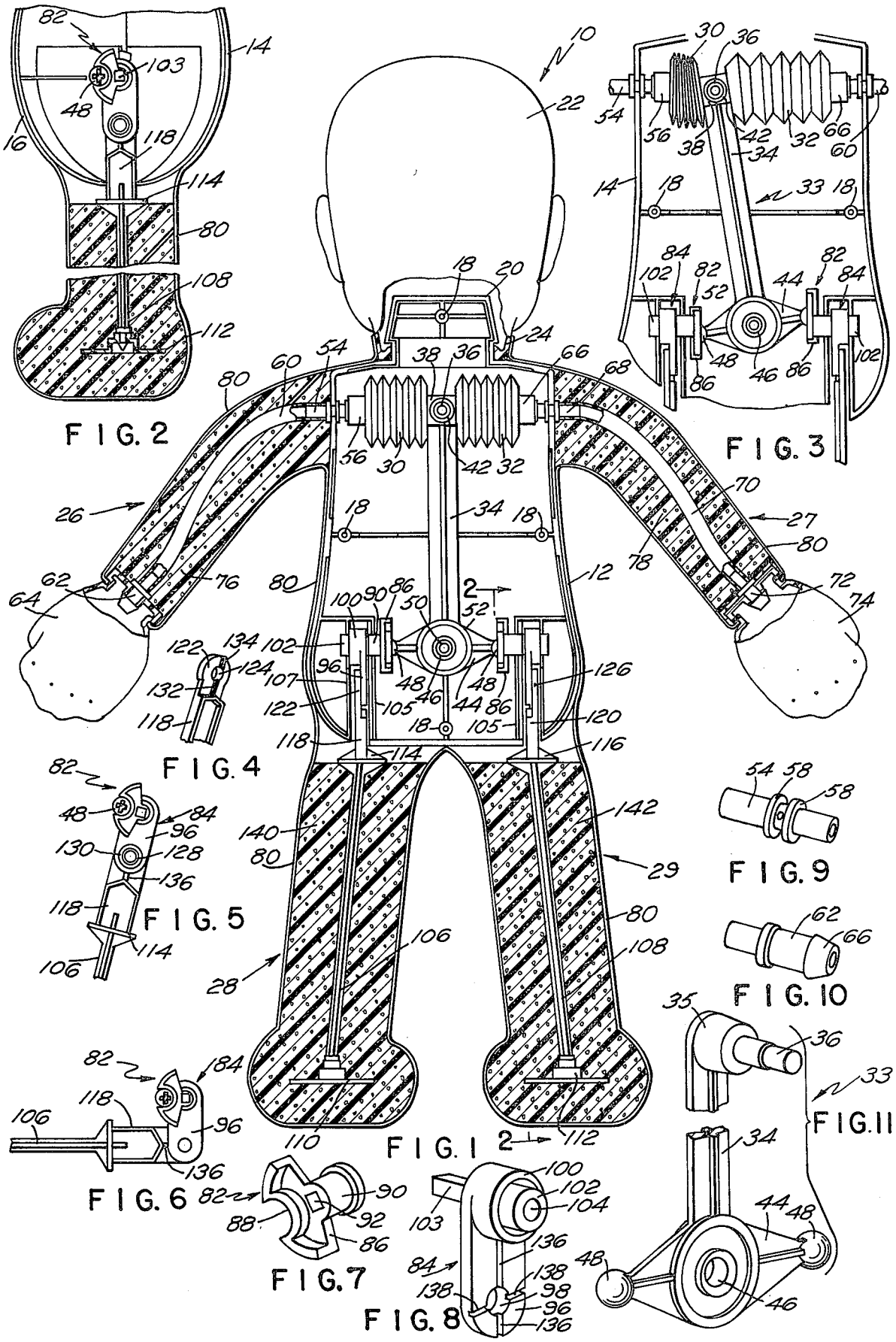
FIG. 1 is a vertical sectional view of the walking doll as embodied in the present invention.
FIG. 2 is a sectional view taken along line 2—2 in FIG. 1.
FIG. 3 is a sectional view of the body of the walking doll similar to FIG. 1 showing the operation of the pneumatic systems therein.
FIG. 4 is a perspective view of the upper portion of a leg section.
FIG. 5 is an elevational view showing the normal standing position of the upper portion of the leg section as joined to a motion transfer device.
FIG. 6 is a view similar to FIG. 5 showing the sitting position of the leg section relative to the motion transfer device.
FIG. 7 is a perspective view of one of the elements of the motion transfer device.
FIG. 8 is a perspective view of the other element of the motion transfer device.
FIG. 9 is a perspective view of an arm connector that joins a bellows of a pneumatic system to an air conduit thereof.
FIG. 10 is a perspective view of a wrist connector pin that joins the conduit of a pneumatic system to a hand of the doll.
FIG. 11 is a perspective view of an actuator member that is interconnected to the motion transfer device.

Referring to the drawing and particularly to FIG. 1, the walking doll embodied in the present invention is illustrated, and is generally indicated at 10. As shown, the walking doll 10 includes a body 12 that is hollow in construction and is preferably formed in two halves as represented by a rear portion 14 and a front portion 16 (FIG. 2). The rear and front portions 14 and 16 of the body are joined together by appropriate fastening means, such as conventional screws that are inserted through openings in the rear portion 14 and that are received in screw holes formed in projecting bosses 18 integrally molded to the front portion 16. Although any suitable material may be utilized in forming the body 12, both the rear and front portions 14 and 16 are molded of a conventional plastic material.

Joined to the uppermost end of the body 12 and projecting thereabove is a neck section 20 on which a head 22 is mounted, the head 22 being formed with a lower flange portion 24 that is snapped over an annular notch as formed on the neck section 20 of the body 12. As will be described, the doll 10 includes arms generally indicated at 26 and 27 that are connectable to the body 12 and further includes legs generally indicated at 28 and 29 that are also connectable to the body 12 at the lowermost end thereof. As will be further described, the arms 26, 27 and legs 28, 29 are formed in a particular manner that provide for the walking movement of the doll. Formed as part of the legs 28 and 29 and located on the outermost ends thereof are enlarged portions that define the feet of the doll.

One of the unique features of the invention embodied herein is the provision of a dual pneumatic system in the body of the doll that is operative to produce a pivoting or walking movement of the legs 28 and 29. For this purpose, a pair of air-operated bellows units 30 and 32 are located interiorly of the body 12 adjacent to the neck section 20. In order to mount the bellows units 30 and 32 for expanding and contracting movement within the body 12 an actuator assembly generally indicated at 33 is provided and includes an actuator rod 34 on the uppermost end of which a projection 35 is formed having a pin 36 extending outwardly therefrom. Joined to the innermost ends of the bellows units 30 and 32 is a connector piece 38 that has an opening formed therein that receives the pin 36 therein for connecting the actuator assembly to the bellows units 30 and 32. A suitable friction washer 42 is mounted on the outermost end of the pin 36 and secures the connector piece 38 to the pin. As illustrate in FIG. 10, the lowermost end of the actuator rod 34 is joined to a transverse portion 44 in which a central opening 46 is formed, the outermost ends of the transverse portion having spherical portions 48 formed thereon. In order to pivotally mount the actuator assembly in the body 12, a pin 50 is molded to the front portion 16 of the body 12 and is received in the opening 46 of the transverse portion 44. A spring washer 52 is frictionally secured to the pin 50 and locks the transverse portion 44 on the pin 50 in pivotal relation. It is seen that the actuator assembly 33 is mounted for pivotal movement in the body 12 on the pivot pin 50, and upon operation of the bellows units 30 and 32 as will be described, the actuator rod 34 and the transverse portion 44 joined thereto will be pivoted to produce a corresponding movement of the spherical portions 48, which movement is translated into a walking movement of the legs 28.

As previously mentioned, each of the bellows units 30 and 32 is formed as part of a separate pneumatic system, and for this purpose a tubular arm connector 54 is joined to a tubular end portion 56 that is joined to the bellows unit 30. Spaced flanges 58 are fixed to the arm connector 54 intermediate the ends thereof to form a space for mounting in suitable grooves as formed in the mating edges of the rear and front portions 14 and 16 of the body 12. As illustrated in FIG. 1, the arm connector 54 extends outwardly of the body portion 12 and receives an end of a tubular conduit 60 thereon in frictional engagement. The arm connector 54 is formed with an interior passage that provides for communication of the conduit 60 with the interior of the bellows unit 30.

The conduit 60 extends interiorly of the arm 26 to the outermost end thereof terminating in a wrist pin 62 on which a hollow hand member 64 is mounted. For this purpose, a frustro-conical portion 66 is formed on the outermost end of the wrist pin 62 which enables an opening as formed in the hand member 64 to be snapped thereover for mounting the hand member 64 on the wrist pin. As illustrated in FIG. 1, the interior of the hollow hand member 64 communicates with the conduit 60 and bellows 30 and defines therewith a separate and independent pneumatic system of the walking doll.

The bellows unit 32 which is formed as part of the other pneumatic system, includes a tubular end portion 66 to which an arm connector 68 is joined, the arm connector 68 being substantially identical to the arm connector 54 and being provided with suitable flanges for mounting on the marginal edges of the rear and front portions 14 and 16 as illustrated. Mounted on the outer end of the arm connector 68 is an air conduit 70 to the outermost end of which a wrist pin 72 is joined, the wrist pin 72 being substantially identical to the wrist pin 62 as previously described and illustrated in FIG. 10. A hollow hand member 74 similar to the hand member 64 is fixed on the wrist pin 72, the interior of the hand member 74 communicating with the interior of the conduit 70 and the bellows unit 32. It is seen that the bellows 32, conduit 70 and hand member 74 define the other pneumatic system and cooperate with the previously described pneumatic system to provide for the required pivotal movement of the actuator assembly 33 for producing the walking action of the doll. As further illustrated in FIG. 1, the arm 26 includes a foam sleeve 76 that envelops the air conduit 60, and the arm 27 includes a similar foam sleeve 77 that envelops the air conduit 70. The foam sleeves 76 and 78 are not only soft and appealing to the child user, but they also enable the arm units to be easily assembled, and further provide an article of substance for handling by the child user. As will be described, a cloth covering 80 defining a dress is applied over the entire body of the doll including the foam sleeves 76 and 78 and the legs 28 and 29 to conceal the connections to the body 12, and to provide an ornamental effect for the doll.

As previously described, the bellows units 30 and 32 are actuated in alternate relation to produce a pivotal movement of the actuator rod 34 and the transverse portion 44 joined to the lower end thereof. In order to translate the pivoting movement of the actuator rod 34 into a walking action of the doll, a motion transfer device is provided for each leg 28 and 29; and, as illustrated in FIGS. 7 and 8, each motion transfer device includes a transfer disc generally indicated at 82 and a swivel member generally indicated at 84, the transfer disc 82 and swivel member 84 being interconnected for movement together. Referring to FIGS. 7 and 8, one of the transfer discs 86 that is formed as part of a motion transfer device is illustrated and includes a segment shaped member 86 in which a socket 88 is formed that receives one of the spherical portions 48 of the transfer portion 44 therein. Joined to the member 86 is a cylindrical shank 90 in which a square-shaped opening 92 is formed. Referring now to FIG. 8, one of the swivel members 94 that forms a part of a motion transfer device is illustrated; and, as will be described, is joined to a leg section for imparting movement thereto upon pivotal movement of the actuator assembly 33. The swivel member 94 includes a lever 96 in which an opening 98 is formed. Joined to the lever 96 is an upper cylindrical portion 100 from the interior of which a hub 102 projects, the hub 102 having an opening 104 formed therein. Joined to the cylindrical portion 100 and extending oppositely to the hub 102 is a stub shaft 103 having a square cross-sectional configuration. In the assembly of the member 84 to the transfer disc 86, the square-shaped shaft 103 is frictionally received in the square-shaped opening 92, thereby interlocking the swivel member and the transfer disc for movement together. Both the swivel member 84 and the transfer disc 82 are mounted for rotating movement in the body 12, the shank 90 being seated in a groove formed in a rib 105 molded in the body, while the hub 102 is seated in a groove formed in a rib 107 also molded in the body. As mounted, the shank 90 and hub 102 both define bearings for the motion transfer device.

As will be described, the motion transfer devices that translate the pivotal movement of the actuator assembly 33 to a walking movement of the legs 28 and 29 are directly interconnected to elements of the legs that are located interiorly thereof. Referring again to FIG. 1, the legs 28 and 29 are shown including elongated leg sections 106 and 108, the leg section 106 having a lower plate 110 formed thereon, while the leg section 108 has a lower plate 112 formed thereon. Upper plates 114, 116 are joined to the uppermost ends of the leg sections 106 and 108, respectively; and extending upwardly from the upper plate 114 and also formed as an integral part of the leg section 106 is an upper leg portion 118. A similar upper leg portion 120 extends upwardly from the plate 116 and is formed as an integral part of the leg section 108. As illustrated in FIG. 4, the upper leg portion 118 is formed with a circular-like portion 122 in which an opening 124 is formed, a similar circular-like portion 126 being formed as part of the upper section 120. The circular portion 122 of the upper leg portion 118 is pivotally connected to the lever 96 of the swivel member 84 by a grommet 128 that extends through the opening 124 and the opening 98 in the lever 96, a spring 130 being held in place by the grommet 128 and urging the upper leg portion 118 into positive contact with the lever 96. A similar construction is utilized for upper portion 120, as is evident from the drawing. It is seen that the upper leg portions 118, 120 normally move with the respective swivel members 94 as they are rotated with the transfer discs 86 upon pivotal movement of the actuator assembly 33 to move the leg sections 106 and 108 therewith thus the actuator assembly and motion transfer devices constitute actuating means which connect the legs to the body and connect the bellows to the legs, so that movement of either bellows member results in movement of each of legs 28 and 29 (see FIG. 3). In the event that the legs 28 and 29 of the doll are to be moved to a sitting position, the upper sections 118 and 120 are rotated relative to the levers 96, as illustrated in FIG. 6 to a perpendicular position with respect thereto. The legs 28 and 29 in this position are located perpendicular to the body 12 and the doll may be disposed in a sitting position. For the purpose of moving the upper leg portions 118 and 120 relative to the levers 96 of the swivel members 94 to a positive sitting or standing position, the circular portion 122 of the plate 118 is formed with aligned projections or detents 132 and 134 (FIG. 4) adjacent to the opening 124. Corresponding grooves 136 (FIG. 8) are formed in the lever 96 adjacent to the opening 98 and receive the detents 132 and 134 therein. Grooves 138 are also formed in the lever 96, 90° removed from the grooves 136, so that when the upper leg portions 118 and 120 are moved relative to the levers 96, the detents 132 and 134 will move into the grooves 138, to locate the legs in a positive sitting position. Return pivotal movement of the upper leg portions 118 and 120 snaps the detents 132, 134 into the grooves 136 to again locate the legs in the standing position.

As shown in FIG. 1, the leg sections 106 and 108 are inclined slightly with respect to the vertical so as to diverge toward the feet of the doll. Forming the leg sections in this manner enables the doll to be easily located in a standing position. The legs 28 and 29 as illustrated in FIG. 1, also include foam sleeves 140 and 142, respectively, the foam sleeves 140, 142 encasing the leg sections 106 and 108, respectively, therein. The covering 80 which defines a dress or play suit or the like also covers the foam sleeves 140 and 142.

In use of the doll 10 and when it is desired to cause the doll to walk, the user holds the hollow hands 64 and 74 and alternately squeezes them to alternately expand and contract the bellows units 30 and 32. As the bellows 32 expands, the bellows unit 30 will contract, as illustrated in FIG. 3. Similarly, expansion of the bellows unit 30 produces a corresponding contraction of the bellows unit 32. This produces a rocking or pivotal movement of the actuator rod 34 and transverse portion 44 around the pivot pin 50. The ball portions 48 are caused to tilt as illustrated in FIG. 3, thereby producing a corresponding rotating movement of the transfer discs 82. As the transfer discs 82 rotate, the swivel members 84 move therewith in a rotating action on the shanks 90 and hubs 102, and since the leg sections 106 and 108 are directly interconnected to the swivel members 84, the legs 28 and 29 will be alternately moved forwardly and rearwardly in a pivotal action. Such pivotal movement of the legs 28 and 29 as produced by the movement of the leg sections 106 and 108 will cause the doll to move forwardly in a walking motion. It is seen that this walking motion will continue so long as the bellows units 30 and 32 are alternately expanded and contracted, it being understood that the hollow hands 64 and 74 must be squeezed independently of the other to produce the corresponding contracting and expanding of the bellows units for pivoting the actuator rod 34.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A walking doll, comprising a hollow body, opposed arms located at the upper portion of said body and a pair of legs located at the lower portion of said body and being mounted for pivotal movement relative thereto, independently air operated pneumatic systems for producing the pivotal movement of said legs, each of said pneumatic systems including a bellows unit located in said body and being expandable in response to the introduction of air therein and an air conduit extending through a said arm interiorly of said body and communicating with a said bellows unit, each of said arms including a hollow member mounted on the outermost end of a said air conduit and defining a hand of said doll, and actuating means interconnecting each leg to said body and being interconnected to said bellows units, so that upon deforming, one of said hollow member, air is injected through its associated air conduit communicating therewith into its associated bellows unit for the expansion thereof, wherein said actuating means effects a corresponding movement of each of said legs in a walking action.

2. A walking doll, comprising a hollow body on which opposed arms are mounted, a pair of legs mounted on said body at the lowermost end thereof in pivotal relation, means mounted in said body and interconnected to said legs for moving said legs in a pivotal walking motion, and air operated means interconnected to said moving means for effecting the movement thereof for pivotally moving said legs, said air operated means including independently operated pneumatic systems for producing the pivotal movement of said legs, and manually operable means associated with each arm and communicating with a said pneumatic system for effecting the operation thereof for producing the pivotal walking motion of said legs, each of said pneumatic systems including an air responsive bellows and an air conduit communicating therewith for transmitting or removing air therefrom to expand or contract said air responsive bellows, said bellows being mounted in mutual longitudinal alignment and said moving means including an actuator transfer rod that is connected at one end thereof to each of and between said bellows for movement in response to the expansion and contraction thereof, the other end of said actuator transfer rod being pivotally connected to said body so that upon expansion and contraction of said bellows said actuator transfer rod is pivotally movable for effecting a corresponding movement of said legs in a walking action.

3. A walking doll as climed in claim 2, each of said legs including an elongated leg section on the uppermost end of which a swivel member is mounted, said moving means being interconnected to a transfer disc to which said swivel members are interconnected for effecting the pivotal movement of said legs, each of said swivel members having relative pivotal movement with respect to the leg section on which it is mounted to enable said legs to be moved to a sitting position.

4. A walking doll as claimed in claim 3, means formed on each of said swivel members and on the uppermost ends of said leg sections that cooperate to effect a positive locating of said legs in either a standing or sitting position.

5. A walking doll as claimed in claim 4, said last-named means including grooves formed on either the swivel members or leg sections and detents formed on the other, wherein said detents cooperate with said grooves to locate said leg sections in either a positive walking or sitting position.

6. A walking doll, comprising a hollow body on which opposed arms ae mounted, a pair of legs mounted on said body at the lowermost end thereof in pivotal relation, means mounted in said body and interconnected to said legs for moving said legs in a pivotal walking motion, and air operated means interconnected to said moving means for effecting the movement thereof for pivotally moving said legs, said air operated means including independently operated pneumatic systems for producing the pivotal movement of said legs, and manually operable means associated with each arm and communicating with a said pneumatic system for effecting the operation thereof for producing the pivotal walking motion of said legs, each of said pneumatic systems including an air responsive member and an air conduit communicating therewith for transmitting or removing air therefrom to expand or contract said air responsive member, each of said air responsive members being defined by a bellows that defines a closed air circuit with a said air conduit communicating therewith, and a hollow hand member joined to the air conduit at the outermost end thereof and defining a hand of the doll, each of said hand members being deformable to inject air through its associated air conduit communicating therewith into its associated bellows for the expansion of the bellows, said bellows being mounted in mutual longitudinal alignment and said moving means including an actuator transfer rod that is connected at one end thereof to each of and between said bellows for movement in response to the expansion and contraction thereof, the other end of said actuator transfer rod being pivotally connected to said body so that upon expansion and contraction of said bellows said actuator transfer rod is pivotally movable for effecting a corresponding movement of said legs in a walking action.

7. A walking doll as claimed in claim 6, each of said legs including an elongated leg section to the uppermost end of which a motion transfer disc is connected, the motion transfer discs being responsive to pivotal movement of said actuator transfer rod in one direction to effect a pivotal movement of said leg sections in another direction.

8. A walking doll, comprising a hollow body on which opposed arms are mounted, a pair of legs mounted on said body at the lowermost end thereof in pivotal relation, means mounted in said body and interconnected to said legs for moving said legs in a pivotal walking motion, and air operated means interconnected to said moving means for effecting the movement thereof for pivotally moving said legs, said air operated means including independently operated pneumatic systems for producing the pivotal movement of said legs, and manually operable means associated with each arm and communicating with a said pneumatic system for effecting the operation thereof for producing the pivotal walking motion of said legs, each of said pneumatic systems including a bellows located in said body and being expandable in response to the introduction of air therein, and an air conduit extending through a said arm and communicating with a said bellows, said manually operable means including a hollow member defining a hand of said doll that communicates with a said air conduit, wherein a squeezing movement of said hand produces a corresponding expansion of the bellows communicating therewith to effect movement of said moving means, said bellows being spaced apart in mutual longitudinal alignment and being connected to each other and to said moving means at a point therebetween, wherein expansion and contraction of said bellows produces a corresponding pivotal movement of said moving means.

9. A walking doll as claimed in claim 8, said moving means including an elongated rod, the lower end of which is pivotally joined to said body and the upper end of which is fixed to said bellows intermediate the inner ends thereof, and motion transfer devices interconnected to the lower end of said rod and responsive to pivotal movement thereof for effecting a corresponding pivotal movement of said legs.

10. A walking doll as claimed in claim 9, the lowermost end of said rod being joined to a transverse portion that forms the pivotal connection of said rod to said body, opposed spherical portions formed on said transverse portion, each of said legs including an elongated leg section, the uppermost portion of which is connected to a motion transfer device, said motion transfer device including a socket for receiving a spherical portion, wherein pivotal movement of said rod and transverse portion joined thereto on an axis in a first direction produces a corresponding pivotal movement of said motion transfer devices and leg sections joined thereto on an axis in a second direction that is perpendicular to the axis in said first direction.

11. A walking doll, comprising a hollow body on which opposed arms are mounted, a pair of legs mounted on said body at the lowermost end thereof in pivotal relation, a pair of air operated bellows mounted interiorly of said body, air conduits, one joined to each bellows and extending through a respective arm, a hollow hand located on the lowermost end of each arm and communicating with an air conduit, each associated bellows, conduit and hand defining a respective closed air system, said bellows being mounted in mutual longitudinal alignment, an actuator rod mounted in said body and connected to both said bellows between said bellows and responsive to movement thereof to effect a pivoting movement, and means interconnecting said actuator rod with the uppermost ends of said legs, wherein pressure alternately exerted on said hollow hands successively compresses and expands said bellows to produce a pivotal movement of said rod and a corresponding alternate pivotal movement of said legs to simulate a walking action thereof.

12. A walking doll as claimed in claim 11, said interconnecting means including a transverse portion joined to said rod at the lowermost end thereof, a pair of spherical members joined to said transverse member on the ends thereof, a motion transfer device joined to the uppermost end of each leg and mounted on said body in pivotal relation, each of said devices including a transfer disc having a socket portion formed therein that receives a spherical member therein, wherein pivotal movement of said rod in one direction causes said spherical members to pivot said transfer discs in another direction, the pivotal movement of said transfer discs producing a corresponding pivotal movement of said legs.

13. A walking doll as claimed in claim 11, each of said legs including an elongated section to which an upper portion is pivotally joined, said upper portions being interconnected to said rod and responsive to pivotal movement thereof to produce the corresponding alternate pivotal movement of said legs, and means formed on said upper portions and elongated sections joined thereto for locating said elongated sections in a position that is aligned with said upper portions to define a standing position for said doll or in a position that is perpendicular to said upper portions to define a sitting position for said doll.

14. A walking doll as claimed in claim 13, said locating means including a projection formed on the upper portion of the elongated section of each leg, and spaced grooves formed on the adjacent surfaces of said upper portion, said projections being receivable in said grooves to define either the standing or sitting positions of said doll.

* * * * *